United States Patent [19]

Melnychenko

[11] 4,448,474

[45] May 15, 1984

[54] STRAIN RELIEF DEVICE

[75] Inventor: Walter Melnychenko, Apalachin, N.Y.

[73] Assignee: International Business Machines Corporation, Armonk, N.Y.

[21] Appl. No.: 365,414

[22] Filed: Apr. 5, 1982

[51] Int. Cl.[3] ..... H01R 13/58

[52] U.S. Cl. ..... 339/103 M; 339/91 R; 339/47 R; 339/176 MF

[58] Field of Search ..... 339/103 R, 103 M, 107, 339/176 MF

[56] References Cited

U.S. PATENT DOCUMENTS

| | | | |
|---|---|---|---|
| 3,614,298 | 10/1971 | Thompson et al. | 339/103 R |
| 3,727,170 | 4/1973 | Mosier et al. | 339/176 MF |
| 3,737,833 | 6/1973 | Jerominek | 339/176 MF |
| 3,854,787 | 12/1974 | Snyder, Jr. | 339/103 R |
| 4,139,727 | 2/1979 | Kuballa | 339/107 |
| 4,210,380 | 7/1980 | Brzostek | 339/107 |
| 4,211,466 | 7/1980 | Reynolds | 339/176 MF |
| 4,278,314 | 7/1981 | Moser et al. | 339/176 MF |
| 4,295,696 | 8/1981 | Gray | 339/103 M |

OTHER PUBLICATIONS

IBM TDB, vol. 4, No. 5, Oct. 1961, p. 33.
IBM TDB, vol. 10, No. 10, Mar. 1968, pp. 1519–1520.
IBM TDB, vol. 18, No. 11, Apr. 1976, p. 3830.

*Primary Examiner*—Joseph H. McGlynn
*Assistant Examiner*—David L. Pirlot
*Attorney, Agent, or Firm*—Elmer W. Galbi

[57] ABSTRACT

A strain relief device is provided for use with a printed circuit card which has a plurality of circuit elements thereon which are soldered to the ends of wire conductors carried in a cable. The device comprises a pair of identical elongated clamp members each having locking elements which enable the members to be aligned on opposite sides of the card and snapped into locking engagement with the conductors clamped therebetween.

6 Claims, 2 Drawing Figures

STRAIN RELIEF DEVICE

BACKGROUND OF THE INVENTION

In printed circuit technology, a printed circuit terminal card is employed which comprises an edge connector containing a plurality of electrical contacts which have their ends on one side of the connector fixed to electrical tabs arranged along one edge of the card. The ends of the contacts on the other side of the connector are pluggable sockets which are electrically plugged to another printed circuit card or board, or the like, which generally would be on the same machine.

On one surface of the printed circuit terminal card is a plurality of electrical terminals or tabs which are solder connected respectively to the ends of a plurality of wire conductors carried in a cable. This cable, for example, could be a power cable which is connected to a power supply. It may be connected internally to the same machine or it may be connected to remote peripheral equipment. It may be necessary from time to time to either repair or replace the terminal card or, as is more often the case, repair or replace the printed circuit card or board to which it is plugged. This necessitates the unplugging of the edge connector. Due to the density and complexity of the arrangement of components and wiring on present day electronic machines, the edge connector generally cannot be reached and so it has to be unplugged by pulling on the cable. This creates a problem in that a strain is placed on the individual wire conductors soldered to the card and breaking of the solder connections occurs.

Strain relief devices have been proposed and used before in an attempt to eliminate this problem. For example, in the case of a flat cable, a snap lock clamp bar has been proposed wherein the end portion of the cable is looped under the bar to allow strain on the cable to be taken up by coaction between the loop and the bar. However, this arrangement would not work satisfactorily for the present application where the end of the cable splits into a plurality of individual conductor wires which are soldered to the circuit board. In another type of strain relief device, a self-locking plug is inserted into a receptacle on a cable connector card clamping a strand of wires into the holes of the card to eliminate the strain at soldered terminals. This arrangement is adapted for use with a flat cable where the individual wires are of uniform size and are not bunched up. Other strain relief devices make use of clamping bars or plates which are clamped together by means of screws. This type of device proved to be time consuming and costly and resulted in poor control of the pressure on the wires. The use of screws can result in too much pressure being applied on the wires which causes the insulation to split or break open and shorts to occur. It became evident that a strain relief device was required which was economical, simple to assemble, and which could be easily used without uncontrolled pressure being applied to the wires.

SUMMARY OF THE INVENTION

The present invention provides a strain relief device for use on a plurality of wires soldered to terminals on the surface of a printed circuit card which is economical to make, simple to use, and which effectively clamps wires extending from a cable without doing damage to the wires and irregardless of the configuration of the cable.

The device comprises a pair of identical elongated clamp members made from a resilient material. Each member has a locking pin and a hook element projecting from the bottom surface thereof and also a conductor recess or cavity formed in said bottom surface. The top surface on each member is provided with a hook latching recess portion and a hole recess portion with a pin hole through the hole recess portion.

A pin hole is provided in each corner of one end of the circuit card. The cable wires extend between the pin holes and along one surface of the card and are soldered to terminals thereon. One of said clamp members is positioned across said one end of the card with the cavity in its bottom surface enclosing the wires and the locking pin projecting therefrom extending down through one of said pin holes in one corner of the card. The other clamp member is inverted and positioned across the opposite surface of the card and at said one end thereof with the locking pin on its bottom surface extending up through the other of said pin holes in the card. Thus, the clamp members are positioned on opposite sides of the card and are in alignment such that they can be simply snapped together whereby the locking pin and hook element of each member will become latched to the hole recess portion and hook latching recess portion of each other. This places the clamp members in locking engagement to provide strain relief for the wires clamped therebetween.

The arrangement provides an improved strain relief device in that it requires only two parts which are identical and would carry the same manufacturing part number. Also, the device is quickly and easily assembled by simply snapping the two parts together. In addition, the use of screws is eliminated which allows for better pressure control to prevent crushing damage to the conductor wires.

Accordingly, a primary object of the present invention is to provide a novel and improved device for providing strain relief.

Another object of the present invention is to provide a novel and improved strain relief device for a plurality of conductor wires connected to the surface of a printed circuit card.

A still further object of the present invention is to provide a novel and improved strain relief device for a plurality of conductor wires connected to the surface of a printed circuit card which is economical to manufacture and easy to assemble.

Another object of the present invention is to provide a novel and improved strain relief device for a plurality of conductor wires connected to the surface of a printed circuit card and which does not cause crushing damage to the wires.

A further object of the present invention is to provide a novel and improved strain relief device which requires only two identical parts.

The foregoing and other objects, features and advantages of the invention will be apparent from the following more particular description of a preferred embodiment of the invention, as illustrated in the accompanying drawings.

DESCRIPTION OF PREFERRED EMBODIMENT

Figure 1:
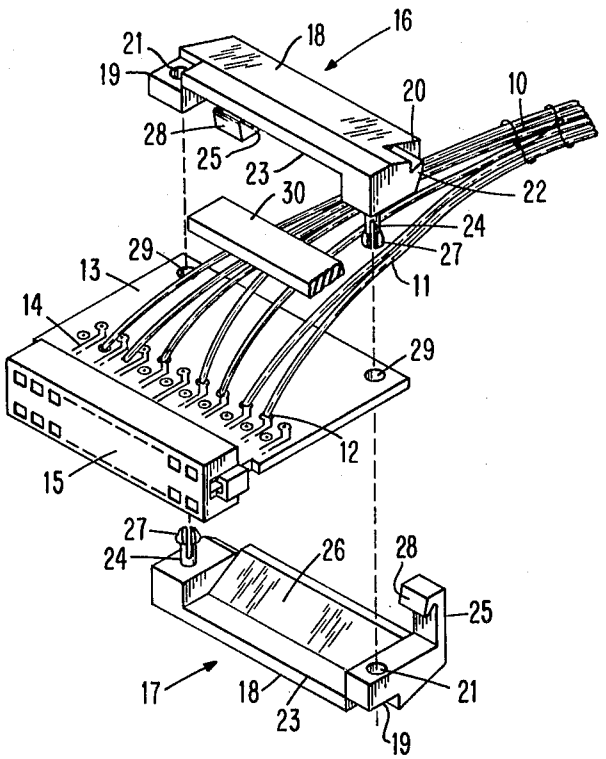
FIG. 1 is an exploded isometric view showing the construction of the strain relief device of the present invention.

Referring to FIG. 1, a cable 10 is shown having a plurality of wire conductors 11 the ends of which are solder connected to a plurality of electrical terminals which may take the form of plated-thru holes 12 in a printed circuit card 13. Circuit lines 14 on the card are electrically fixed or soldered to spring contacts in a pluggable edge connector 15.

The present strain relief device for use with the above cable and circuit card assembly comprises two elongated clamp members 16 and 17. The clamp members 16 and 17 have identical configurations and carry the same manufacturing part number requiring only one mold, or the like. The members should be constructed of a material which is not too brittle, has flexibility, and is stable under moisture conditions. A polycarbon material is preferred such as, for example, Lexan, a proprietary product of the General Electric Co., which are thermoplastic polycarbonate resins used as molding or extrusion compounds. The resins possess an unusual combination of toughness, impact strength, heat resistance and dimensional stability.

Since the clamp members are identical, like reference numbers will be used to describe their configuration. In this connection, it should be noted that lower member 17 is shown inverted with respect to upper member 16.

Each member includes on its top surface 18 a hole recess portion 19 in one corner and a hook latching recess 20 in the diagonally opposite corner. The hole recess has a pin hole 21 therethrough and the latching recess has a V-shaped latching projection 22 formed thereon. The bottom surface 23 of each member includes a locking pin 24 projecting from one corner thereof and a hook element 25 projecting from the diagonally opposite corner. These corners are the diagonally opposite corners from those used on the top surface. Also formed on the bottom surface is a V-shaped cavity or recess 26 for housing the wire conductors 11. As shown, the locking pin 24 is bifurcated and the end is provided with barbs 27. The hook element has a V-shaped hook projection 28 at its end.

A pin guide hole 29 is provided in the corners at the free end of the circuit card. To assemble the device for use, the upper clamp member 16 is positioned across the free edge of the card with its bottom surface 26 facing the card and wires. A resilient cushon member 30 could be positioned between the member and the wires, but it is seldom required. The locking pin 24 is inserted through its associated pin guide hole 29 and the member positioned against the card so that the wires are enclosed in the cavity 26, the locking pin 24 and hook element 25 extend beyond the thickness of the card, and the pin hole 21 in the hole recess is in alignment with its associated pin guide hole 29 in the card.

Figure 2:
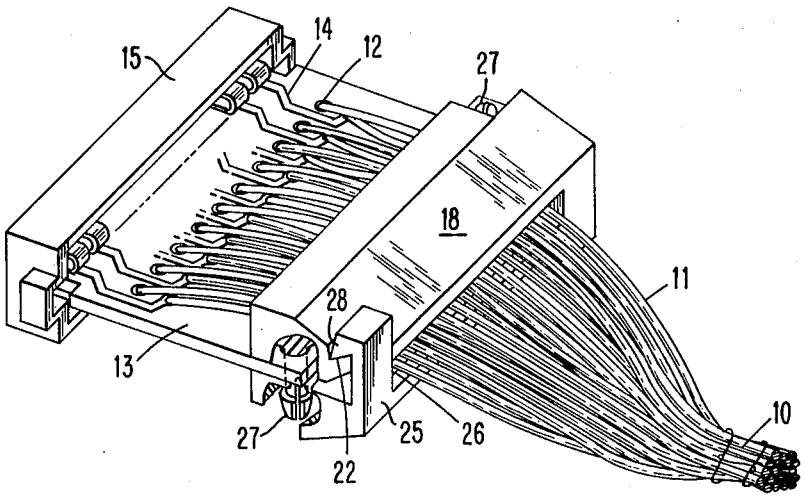
FIG. 2 is an isometric view showing the assembly of the strain relief device shown in FIG. 1.

The lower clamp member 17 is inverted and positioned across the free edge so that its bottom surface 23 and cavity 26 face the opposite side of the card, its locking pin 24 is in alignment with associated pin guide hole 29 and the pin hole 21 in the upper member, and its pin hole 21 is in alignment with the locking pin 24 in the upper member. The members are now snapped or pushed together to the assembled position shown in FIG. 2. In this position, locking pin 24 on the lower clamp member extends through pin guide hole 29 and through the pin hole 21 in the upper clamp member and the barbs 27 latch onto the surface of the pin hole recess 19. Similarly, locking pin 24 on the upper clamp member extends through the pin hole 21 in the lower clamp member and its barbs 27 latch onto the surface of the pin hole recess 19. The bifurcated construction of the locking pins allows the barbs to be compressed during insertion in the hole and allows them to spread apart to latch onto the recess surface and lock the pins in place. In addition, the V-shaped hook projection 28 on hook element 25 of the lower clamp member will be cammed by the V-shaped latching projection 22 on the upper clamp member and will snap into latching engagement therewith, as shown in FIG. 2. The V-shaped hook projection on the upper clamp member and the V-shaped latching projection on the lower clamp member coact in the same manner.

It can be seen then that the clamp members are locked into engagement. The V-shaped configuration of the cavity in the bottom surface of the members results in one portion of the conductor wires being retained to the card and since the members and the longer and more inclined slop in their cavity extend beyond the edge of the card, another portion of the wires is clamped directly between the members. Thus, an effective strain relief is provided for the wires to prevent breaking of the solder connections when the cable is pulled on.

As was mentioned, the elimination of the use of clamping screws in the present device allows for better control of the clamping pressure on the wires by the assembly. The size of the member and its cavity is made to accommodate the size of cable and conductor wires to be relieved and simple snapping of the members together would no adjustment required prevents ineffective clamping of the wires too loosely or clamping them too tightly which would cause crushing of the wires and breaking of the insulation resulting in shorts. In cases where only a few wires are used, as shown in FIG. 1, the cushion member 30 may be used as a filler only. Where a larger number of wires are used, as shown in FIG. 2, the cushion is not required.

If required, the assembled members may be separated by gently prying them out of engagement.

While the invention has been particularly shown and described with reference to a preferred embodiment thereof, it will be understood by those skilled in the art that various changes in form and detail may be made therein without departing from the spirit and scope of the invention.

What is claimed is:

1. In a printed circuit card assembly having a plurality of electrical terminals thereon electrically connected respectively to the ends of a plurality of wire conductors carried in a cable and a pin hole located in each corner at one end of the card, a strain relief device for the wire conductors comprising:

a pair of identically configured elongated clamp members each of which has a locking pin and a hook element projecting from the bottom surface thereof and a wire conductor receiving cavity in said bottom surface, and a hook latching recess and a hole recess in the top surface thereof with a pin hole through said hole recess, one of said members being positioned across the top surface of the card with its locking pin extending through one of said card pin holes and bottom surface cavity receiving said wire conductors, the other of said members being positioned across the bottom surface of the card and being inverted with respect to said one member and having its locking pin extending through the other card pin hole whereby said members may be snapped together into locking engagement with one portion of said wire conductors being retained against one surface of the card by one of said members and another portion of said wire conductors being clamped directly between said members beyond the pin hole edge of the card to provide effective strain relief.

2. The strain relief device as set forth in claim 1 wherein said locking pin and hole recess are arranged diagonally in one direction in two corners on opposite surfaces of each member and said hook element and hook latching recess are arranged diagonally in the opposite direction in the other two corners on said opposite surfaces.

3. In a printed circuit card assembly having a plurality of electrical terminals thereon electrically connected respectively to the ends of a plurality of wire conductors carried in a cable and a pin hole located in each corner at one end of the card, a strain relief device for the wire conductors comprising:

upper and lower identically configured elongated clamp members each of which has a locking pin and a hook element projecting from the bottom surface thereof and a wire conductor receiving cavity in said bottom surface, and a hook latching recess and a hole recess in the top surface thereof with a pin hole through said hole recess, said upper member being positioned across the top surface of the card with its locking pin extending through one of said card pin holes and bottom surface cavity receiving said wire conductors, said lower member being positioned across the bottom surface of the card inverted and in alignment with respect to said upper member and having its locking pin extending through the other card pin hole whereby snapping of the members together results in the latching of the locking pins with the pin hole recesses and the hook elements with the hook latching recess to put said members into locked engagement with one portion of said wire conductors being retained against the top surface of the card by said upper member and another portion of said wire conductors being clamped directly between both said members beyond the pin hole edge of the card to provide effective strain relief.

4. The strain relief device as set forth in claim 3 wherein said locking pins are bifurcated with end barbs for latching coaction with said pin hole recesses and said hook latching recesses have a camming surface for latching coaction with said hook elements.

5. The strain relief device as set forth in claim 3 and including a cushion filler member positioned between the cavity in said upper member and the wire conductors.

6. The strain relief device as set forth in claim 3 wherein a portion of said upper and lower clamp members and the cavities therein extends beyond the edge of the circuit card to effectively clamp the wire conductors between said members.

* * * * *